US011586133B2

(12) United States Patent
Hiramatsu et al.

(10) Patent No.: US 11,586,133 B2
(45) Date of Patent: Feb. 21, 2023

(54) LAYER TRANSFER DEVICE

(71) Applicant: BROTHER KOGYO KABUSHIKI KAISHA, Nagoya (JP)

(72) Inventors: Seiji Hiramatsu, Nagoya (JP); Kyoko Sugiyama, Nagoya (JP); Tomoya Ichikawa, Nagoya (JP); Tomoya Yamamoto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/383,481

(22) Filed: Jul. 23, 2021

(65) Prior Publication Data

US 2021/0349413 A1 Nov. 11, 2021

Related U.S. Application Data

(63) Continuation of application No. PCT/JP2019/020692, filed on May 24, 2019.

(30) Foreign Application Priority Data

Jan. 31, 2019 (JP) ..... JP2019-015456

(51) Int. Cl.
*G03G 15/20* (2006.01)

(52) U.S. Cl.
CPC ..... *G03G 15/2039* (2013.01); *G03G 15/20* (2013.01)

(58) Field of Classification Search
CPC ..... G03G 15/2039; G03G 15/20
See application file for complete search history.

(56) References Cited

U.S. PATENT DOCUMENTS 7,200,355 B2 4/2007 Uchiyama et al.
8,364,052 B2 1/2013 Iwaya
(Continued)

FOREIGN PATENT DOCUMENTS

CN 1648786 A 8/2005
CN 102023546 A 4/2011
(Continued)

OTHER PUBLICATIONS

International Preliminary Report on Patentability and Written Opinion of the International Searching Authority issued in corresponding International Patent Application No. PCT/JP2019/020692, dated Jul. 27, 2021.
(Continued)

*Primary Examiner* — Clayton E. LaBalle
*Assistant Examiner* — Michael A Harrison
(74) *Attorney, Agent, or Firm* — Merchant & Gould P.C.

(57) ABSTRACT

Disclosed is a layer transfer device which transfers a layer of a multilayer film onto a surface of a sheet. The layer transfer device includes a heating member including a first portion and a second portion, a first heater, a second heater, and a controller. The controller is configured to control the first heater with an input power set at a predetermined input power, control the second heater with an input power set at a first input power if both of the multilayer film and the sheet pass over a surface of the second portion, and control the second heater with an input power set at a second input power that is smaller than the first input power if at least one of the multilayer film and the sheet does not pass over the surface of the second portion.

20 Claims, 10 Drawing Sheets

(56) References Cited

U.S. PATENT DOCUMENTS

| | | | | |
|---|---|---|---|---|
| 9,042,799 | B2 | 5/2015 | Hase et al. | |
| 9,285,724 | B2 | 3/2016 | Hase et al. | |
| 9,501,012 | B2 | 11/2016 | Ogawa et al. | |
| 9,632,464 | B2 | 4/2017 | Shiki et al. | |
| 9,715,198 | B2 | 7/2017 | Hase et al. | |
| 10,095,165 | B2 | 10/2018 | Ogawa et al. | |
| 10,209,654 | B2 | 2/2019 | Hase et al. | |
| 10,551,777 | B2 | 2/2020 | Hase et al. | |
| 10,564,579 | B2 | 2/2020 | Ogawa et al. | |
| 11,003,119 | B2 | 5/2021 | Hase et al. | |
| 11,353,812 | B2 | 6/2022 | Hase et al. | |
| 2004/0188023 | A1* | 9/2004 | Sasaki | B32B 37/182 156/359 |
| 2005/0169679 | A1 | 8/2005 | Uchiyama et al. | |
| 2011/0064443 | A1 | 3/2011 | Iwaya et al. | |
| 2013/0183072 | A1 | 7/2013 | Hase et al. | |
| 2015/0063852 | A1 | 3/2015 | Ota | |
| 2015/0160591 | A1 | 6/2015 | Hase et al. | |
| 2016/0098001 | A1 | 4/2016 | Ogawa et al. | |
| 2016/0147185 | A1 | 5/2016 | Hase et al. | |
| 2016/0327889 | A1 | 11/2016 | Shiki et al. | |
| 2017/0017182 | A1 | 1/2017 | Saito et al. | |
| 2017/0031284 | A1 | 2/2017 | Ogawa et al. | |
| 2017/0285542 | A1 | 10/2017 | Hase et al. | |
| 2019/0004460 | A1 | 1/2019 | Ogawa et al. | |
| 2019/0121271 | A1 | 4/2019 | Hase et al. | |
| 2020/0117126 | A1* | 4/2020 | Hase | G03G 15/2017 |
| 2021/0223730 | A1 | 7/2021 | Hase et al. | |

FOREIGN PATENT DOCUMENTS

| | | | |
|---|---|---|---|
| CN | 103207554 | A | 7/2013 |
| CN | 104423240 | A | 3/2015 |
| CN | 106125529 | A | 11/2016 |
| JP | 60-143370 | A | 7/1985 |
| JP | 62-63974 | A | 3/1987 |
| JP | 2-254481 | A | 10/1990 |
| JP | 4-136882 | A | 5/1992 |
| JP | 8-99428 | A | 4/1996 |
| JP | 8-220930 | A | 8/1996 |
| JP | 2015-169678 | A | 9/2015 |
| JP | 2016-71284 | A | 5/2016 |
| JP | 2017-27015 | A | 2/2017 |
| JP | 2017-181833 | A | 10/2017 |
| KR | 20130085808 | A | 7/2013 |

OTHER PUBLICATIONS

International Search Report issued in corresponding International Patent Application No. PCT/JP2019/020692, dated Jul. 16, 2019.
First Office Action issued in corresponding Chinese Patent Application No. 201980090941.X, dated May 6, 2022.

* cited by examiner

| | CENTER SHEET SENSOR | SIDE SHEET SENSOR |
|---|---|---|
| SH1 | ON | ON |
| SH2 | ON | — |
| SH3 | ON | ON |

| FIRST SENSOR | SECOND SENSOR | THIRD SENSOR | DETECTION |
|---|---|---|---|
| LOW | LOW | LOW | FU1 |
| LOW | HIGH | LOW | FU2 |
| LOW | LOW | HIGH | FU3 |
| HIGH | HIGH | HIGH | NOT INSTALLED |

LAYER TRANSFER DEVICE

CROSS-REFERENCE TO RELATED APPLICATION(S)

This application is a continuation application of International Application No. PCT/JP2019/020692 filed on May 24, 2019 which claims priority from Japanese Patent Application No. 2019-015456 filed on Jan. 31, 2019, the disclosure of which is incorporated herein by reference in its entirety.

TECHNICAL FIELD

The present disclosure relates to a layer transfer device comprising a heating member.

BACKGROUND ART

A thermal fixing device with a heating member for fixing an image on a sheet is conventionally known in the art. The thermal fixing device includes a heater with a plurality of heating elements aligned in a width direction of the heater. The thermal fixing device is capable of individually switching the heating elements ON and OFF. When a width of a sheet conveyed through the thermal fixing device is narrow, the heating elements close to ends of the heater are switched OFF.

SUMMARY

In a layer transfer device, even if a heater is controlled with consideration given to a width of a sheet, a heating member could possibly be heated wastefully by the heater unless a width of a layer to be transferred is considered.

It would be desirable to restrain wasteful heating of a heating member in a layer transfer device.

Against the backdrop described above, a layer transfer device for transferring a layer of a multilayer film onto an image formed on a sheet is disclosed. The layer transfer device comprises a heating member configured to contact and heat the multilayer film and extending along a width direction of the multilayer film, a first heater configured to heat a first portion of the heating member more intensively than a second portion of the heating member, a second heater configured to heat the second portion more intensively than the first portion, and a controller. The width direction is orthogonal to a direction of conveyance of the multilayer film. The first portion and the second portion are arranged side by side along the width direction.

During transfer of the layer, the controller is configured to control the first heater with an input power set at a predetermined input power, control the second heater with an input power set at a first input power if both of the multilayer film and the sheet pass over a surface of the second portion, and control the second heater with an input power set at a second input power that is smaller than the first input power if at least one of the multilayer film and the sheet does not pass over the surface of the second portion.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

A detailed description will be given of a non-limiting embodiment with reference made to the drawings where appropriate.

Figure 1:
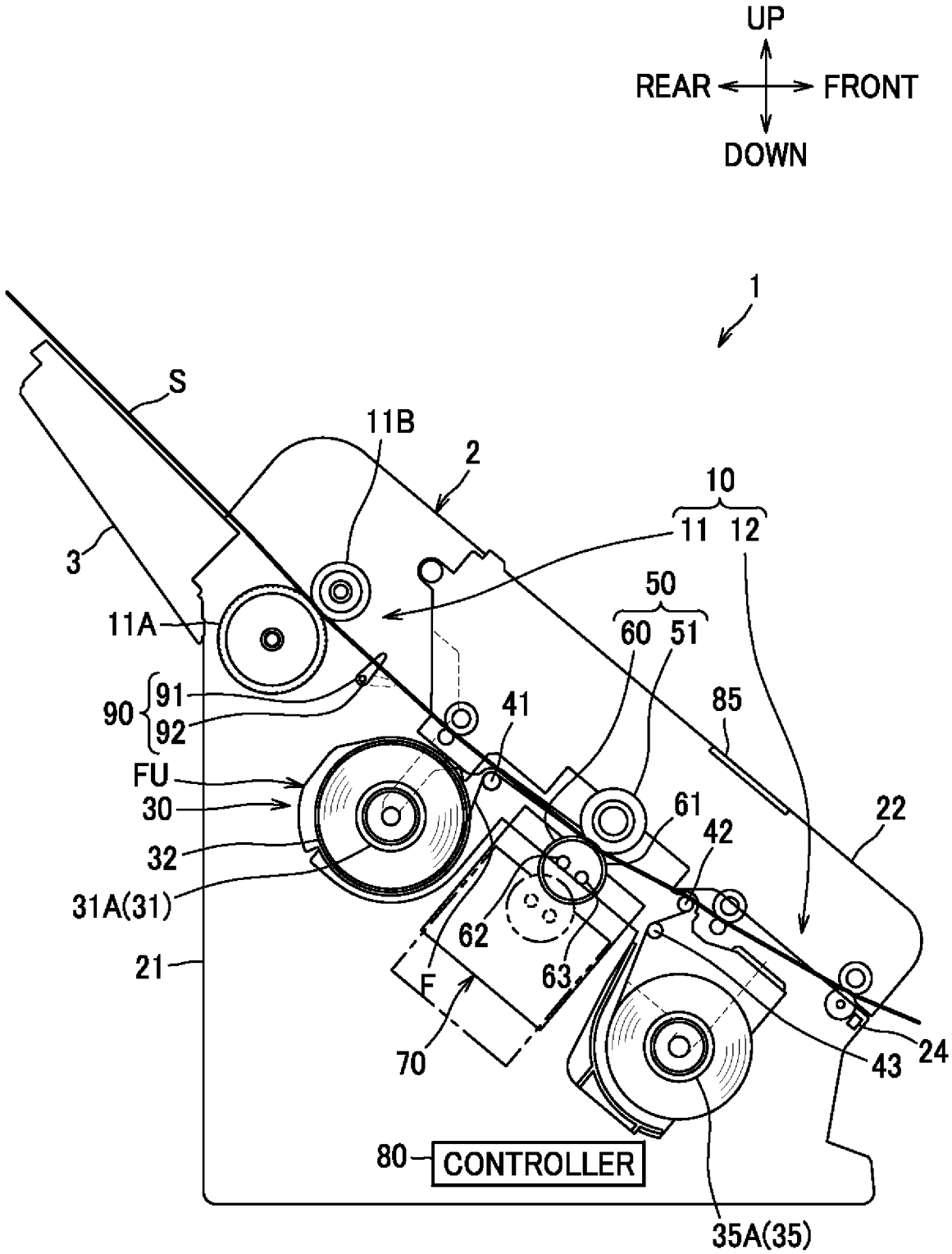
FIG. 1 is a diagram showing an embodiment of a layer transfer device.

In the following description, directions will be referred to as directions shown in FIG. 1. That is, the right-hand side of FIG. 1 is referred to as "front", the left-hand side of FIG. 1 as "rear", the front side of the drawing sheet of FIG. 1 as "left", and the back side of the drawing sheet of FIG. 1 as "right". Similarly, up/down directions (upper/lower sides) of FIG. 1 are referred to as "up/down (upward/downward, upper/lower)".

As shown in FIG. 1, a layer transfer device 1 is a device for post-processing a sheet S on which a toner image is formed by an image forming apparatus, for example, a laser printer or the like. More specifically, the layer transfer device 1 is a device configured to overlay a multilayer film including a plurality of layers on a surface of the sheet on which a toner image is formed, and transfer at least one layer of the multilayer film onto the toner image. The layer transfer device 1 includes a housing 2, a sheet tray 3, a sheet conveyor unit 10, a film supply unit 30, a transfer unit 50 and a controller 80.

The housing 2 is made of plastic or the like, and includes a housing main body 21 and a cover 22. The housing main body 21 has an opening 21A at its upper side (see FIG. 2). The opening 21A has a size that allows a film unit FU as will be described later to pass therethrough.

The housing main body 21 includes a first locating portion GD1 and a second locating portion GD2 for holding and locating the film unit FU which will be described later in the housing main body 21 in a manner that permits the film unit FU to be installed into and removed from the housing main body 21. To be more specific, the first locating portion GD1 holds bosses 111C which will be described later, and the second locating portion GD2 holds a take-up reel 35 which will be described later.

The cover 22 is a member for opening and closing the opening 21A. A rear end portion of the cover 22 is rotatably supported by the housing main body 21. The cover 22 is rotatable between a closed position for closing the opening 21A (position of FIG. 1) and an open position for opening the opening 21A (position of FIG. 2).

The sheet tray 3 is a tray on which sheets S such as paper, OHP film, etc., are placed. The sheet tray 3 is provided at a rear portion of the housing 2. The sheets S are placed on the sheet tray 3 with surfaces of the sheets S having toner images formed thereon facing downward.

The sheet conveyor unit 10 includes a sheet feed mechanism 11 and a sheet ejection mechanism 12. The sheet feed mechanism 11 is a mechanism that conveys sheets S on the sheet tray 3 one by one toward the transfer unit 50. The sheet feed mechanism 11 includes a pickup roller 11A and a retard roller 11B. The pickup roller 11A feeds a sheet S on the sheet tray 3 toward the transfer unit 50. The retard roller 11B is opposed to the pickup roller 11A. The retard roller 11B rotates in a direction that conveys a sheet S toward the sheet tray 3 to separate the sheets S one by one.

The sheet ejection mechanism 12 is a mechanism that ejects a sheet S which has passed through the transfer unit 50, to the outside of the housing 2. The sheet ejection mechanism 12 includes a plurality of conveyor rollers.

The film supply unit 30 is a unit that supplies and lays a multilayer film F onto a sheet S conveyed from the sheet feed mechanism 11. The film supply unit 30 includes the film unit FU, and a driving source 80 (not shown) such as a motor.

Figure 2:
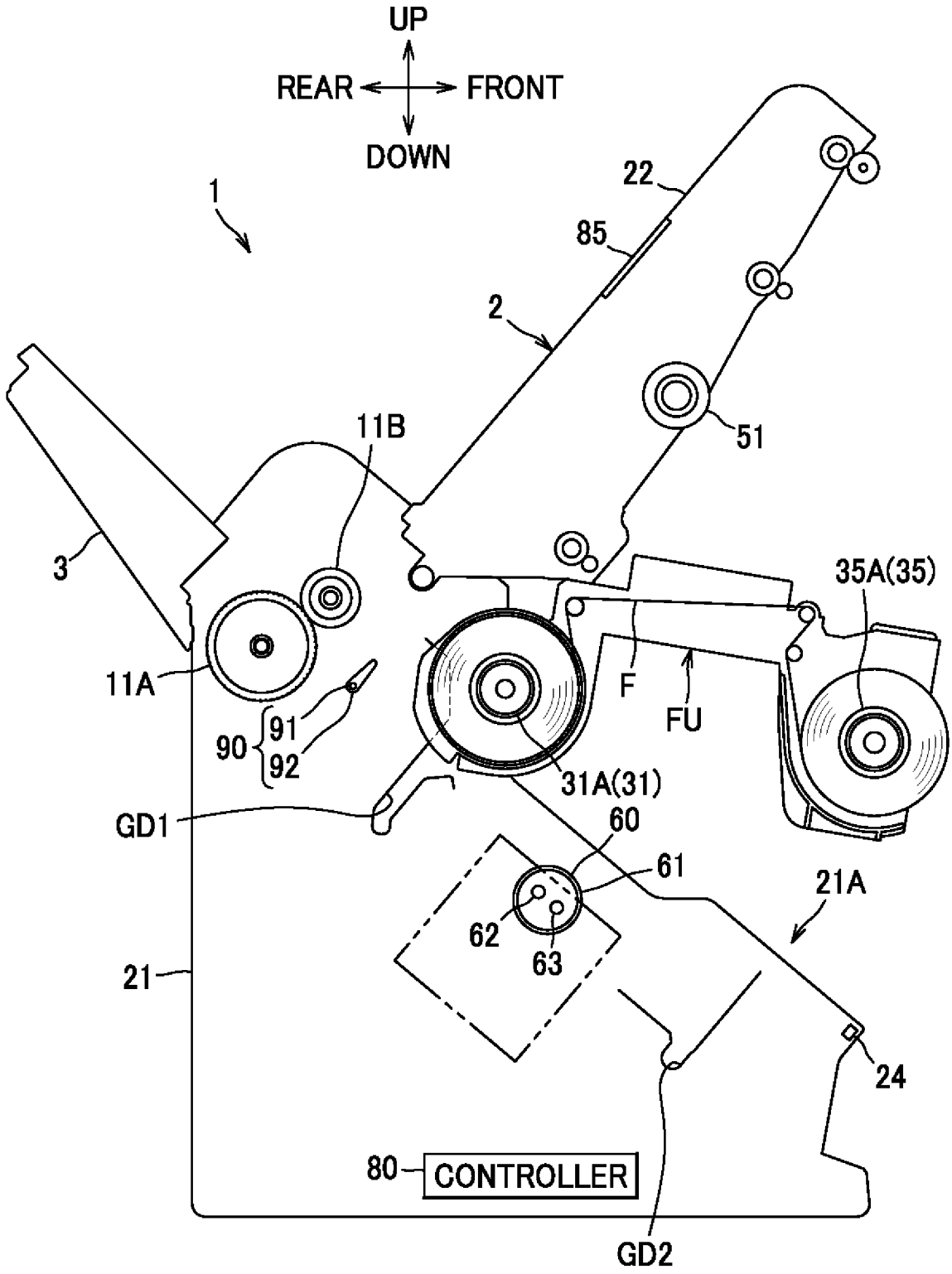
FIG. 2 is a diagram showing the layer transfer device with a cover opened.

The film unit FU is configured, as shown in FIG. 2, to be installable into and removable from the housing main body 21 through the opening 21A along a direction orthogonal to an axial direction of a supply reel 31 which will be described later. As shown in FIG. 1, the film unit FU includes a multilayer film F, a supply reel 31, a take-up reel 35, a first guide shaft 41, a second guide shaft 42, and a third guide shaft 43.

The multilayer film F is a film consisting of a plurality of layers. Specifically, the multilayer film F includes a supporting layer and a supported layer. The supporting layer is a transparent substrate in the form of a tape and made of polymeric material. The supporting layer supports the supported layer. The supported layer includes, for example, a release layer, a transfer layer, and an adhesive layer. The release layer is a layer for facilitating separation of the transfer layer from the supporting layer, and is interposed between the supporting layer and the transfer layer.

The transfer layer is a layer to be transferred onto a toner image, and contains foil. Foil is a thin sheet of metal such as gold, silver, copper, aluminum, etc. The transfer layer is interposed between the release layer and the adhesive layer. The adhesive layer is a layer for facilitating adhesion of the transfer layer to a toner image.

The supply reel 31 is made of plastic or the like, and includes a supply shaft 31A on which the multilayer film F is wound. One end of the multilayer film F is fixed to the supply shaft 31A. The multilayer film F is wound on the supply reel 31 with the supporting layer facing outside and the supported layer (transfer layer) facing inside.

The take-up reel 35 is made of plastic or the like, and includes a take-up shaft 35A on which to take up the multilayer film F. The other end of the multilayer film F is fixed to the take-up shaft 35A. The multilayer film F is wound on the take-up reel 35 with the supporting layer facing outside and the supported layer (transfer layer) facing inside.

It is to be understood that in FIG. 1 or other figures, the supply reel 31 and the take-up reel 35 are illustrated as if the multilayer film F were wound on both reels up to the maximum. In actuality, a new film unit FU has a multilayer film F wound on the supply reel 31 in a roll of a maximum diameter, whereas no multilayer film F is wound on the take-up reel 35, or the multilayer film F is wound on the take-up reel 35 but in a roll of a minimum diameter. When the film unit FU is at the end of its life (i.e., the multilayer film F has been exhausted), the multilayer film F is wound on the take-up reel 35 in a roll of a maximum diameter, whereas no multilayer film F is wound on the supply reel 31, or the multilayer film F is wound on the supply reel 31 but in a roll of a minimum diameter.

The first guide shaft 41 is a shaft for changing a traveling direction of the multilayer film F drawn out from the supply reel 31. The second guide shaft 42 is a shaft for changing a traveling direction of the multilayer film F guided by the first guide shaft 41. The third guide shaft 43 is a shaft for changing a traveling direction of the multilayer film F guided by the second guide shaft 42 toward the take-up reel 35.

When the film unit FU is installed into the housing main body 21 and set in the layer transfer device 1, the take-up reel 35 is caused to rotate counterclockwise as in the drawing by the driving source (not shown) provided in the housing 2. As the take-up reel 35 rotates, the multilayer film F wound on the supply reel 31 is drawn out, and the multilayer film F thus drawn out is taken up on the take-up reel 35. To be more specific, during the layer transfer process, the multilayer film F is forwarded by a pressure roller 51 and a heating unit 60 which will be described later whereby the multilayer film F is drawn out from the supply reel 31. The multilayer film F forwarded through the pressure roller 51 and the heating unit 60 is taken up on the take-up reel 35.

The first guide shaft 41 guides the multilayer film F drawn out from the supply reel 31 in such a manner that the multilayer film F is laid under a sheet S being conveyed with a toner image facing downward. The first guide shaft 41 changes a direction of conveyance of the multilayer film F drawn out from the supply reel 31, and guides the multilayer film F in a direction substantially parallel to the direction of conveyance of the sheet S. The direction of conveyance of the sheet S is also simply referred to as "conveyance direction" in the following description.

The second guide shaft 42 contacts the multilayer film F having passed through the transfer unit 50, and changes a direction of conveyance of the multilayer film F having passed through the transfer unit 50 to a direction different from a direction of conveyance of a sheet S. The multilayer film F having passed through the transfer unit 50 and conveyed with the sheet S laid thereon is guided in the direction different from the direction of conveyance of the sheet upon passing the second guide shaft 42, and peeled from the sheet S.

The transfer unit 50 is a unit that heats and pressurizes the sheet S and the multilayer film F laid on one another, to transfer the transfer layer onto a toner image formed on the sheet S. The transfer unit 50 includes a pressure roller 51 and a heating unit 60. The transfer unit 50 applies heat and pressure to portions of a sheet S and a multilayer film F laid on one another and nipped between the pressure roller 51 and the heating unit 60.

The pressure roller 51 is a roller comprising a cylindrical metal core with its cylindrical surface coated with a rubber layer made of silicone rubber. The pressure roller 51 is located above the multilayer film F, and is contactable with a back side (opposite to a side on which a toner image is formed) of the sheet S.

The pressure roller 51 has two ends supported rotatably by the cover 22. The pressure roller 51 nips the sheet S and the multilayer film F in combination with the heating unit 60. The pressure roller 51 is driven to rotate by the driving source (not shown) and causes the heating unit 60 to rotate accordingly.

Figure 3:
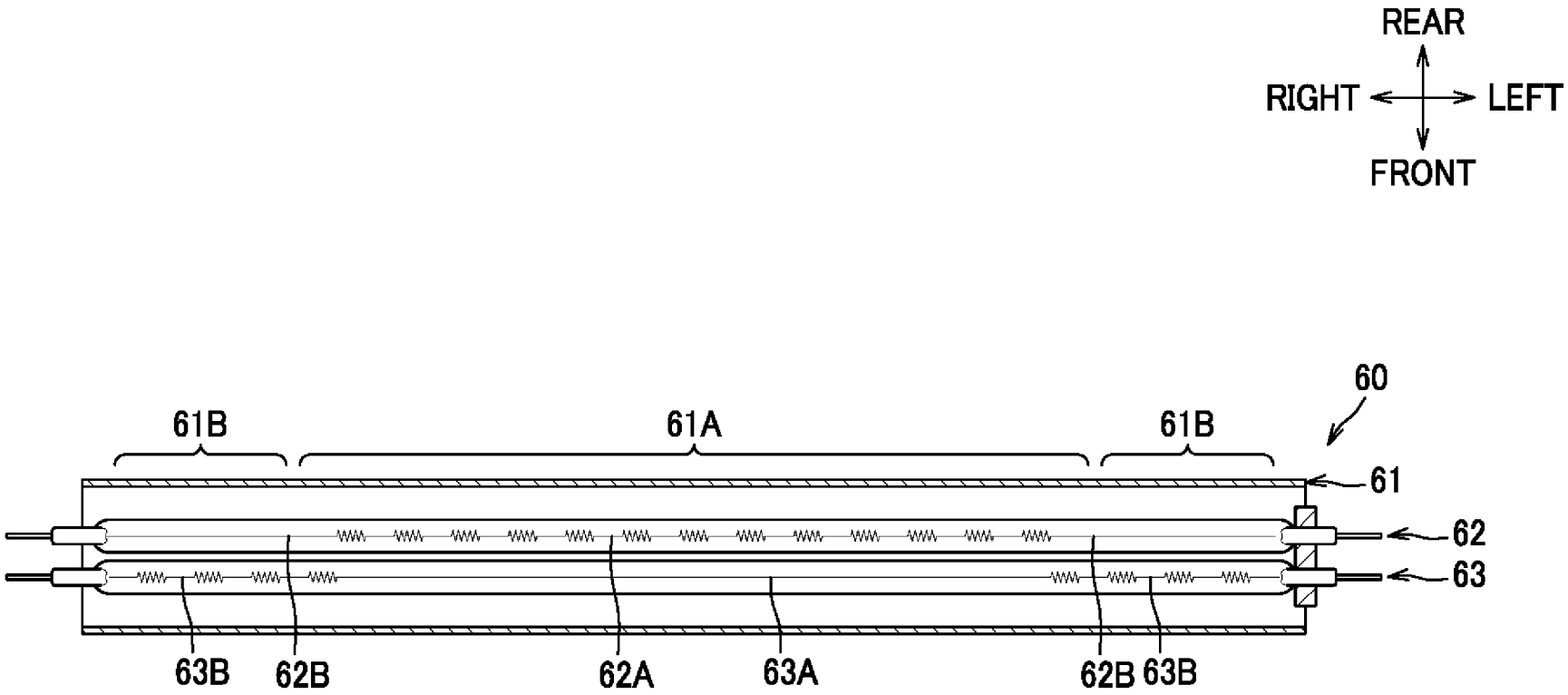
FIG. 3 is a section view of a heating unit.

The heating unit 60 is a unit located below the multilayer film F and configured to contact the multilayer film F and heat the multilayer film F and the sheet S. The heating unit 60 extends along a direction of width of the multilayer film F (simply referred as "width direction" in the following description). The width direction is orthogonal to the direction of conveyance of the multilayer film F. As shown in FIG. 3, the heating unit 60 comprises a heating member 61, a first heater 62, and a second heater 63.

The heating member 61 is a roller comprising a cylindrical metal tube. The heating member 61 is a member that contacts the multilayer film F and heats the multilayer film F and the sheet S. The heating member 61 has a first portion 61A and second portions 61B. The first portion 61A is a midsection of the heating member 61. The second portions 61B are end sections of the heating member 61. The first portion 61A and the second portions 61B are arranged side by side along the width direction.

The first heater 62 heats the heating member 61. The first heater 62 includes a midsection 62A and end sections 62B. The end sections 62B are located apart from each other in the width direction with the midsection 62A located therebetween. The midsection 62A of the first heater 62 is arranged to heat the first portion 61A of the heating member 61. The end sections 62B of the first heater 62 are arranged to respectively heat the second portions 61B of the heating member 61. A thermal output of the midsection 62A is higher than thermal outputs of the end sections 62B. Accordingly, the first heater 62 is configured to heat the first portion 61A of the heating member 61 more intensively than the second portions 61B of the heating member 61. In the illustrated example, the width of the first portion 61A is 150 to 180 mm. Thus, it is possible to heat an A4 size sheet S by using only the first heater 62.

The second heater 63 heats the heating member 61. The second heater 63 includes a midsection 63A and end sections 63B. The end sections 63B are located apart from each other in the width direction with the midsection 63A located therebetween. The midsection 63A of the second heater 63 is arranged to heat the first portion 61A of the heating member 61. The end sections 63B of the second heater 63 are arranged to respectively heat the second portions 61B of the heating member 61. Thermal outputs of the end sections 63B are higher than a thermal output of the midsection 63A. Accordingly, the second heater 63 is configured to heat the second portions 61B of the heating member 61 more intensively than the first portion 61A of the heating member 61.

Figures 4A, 4B:
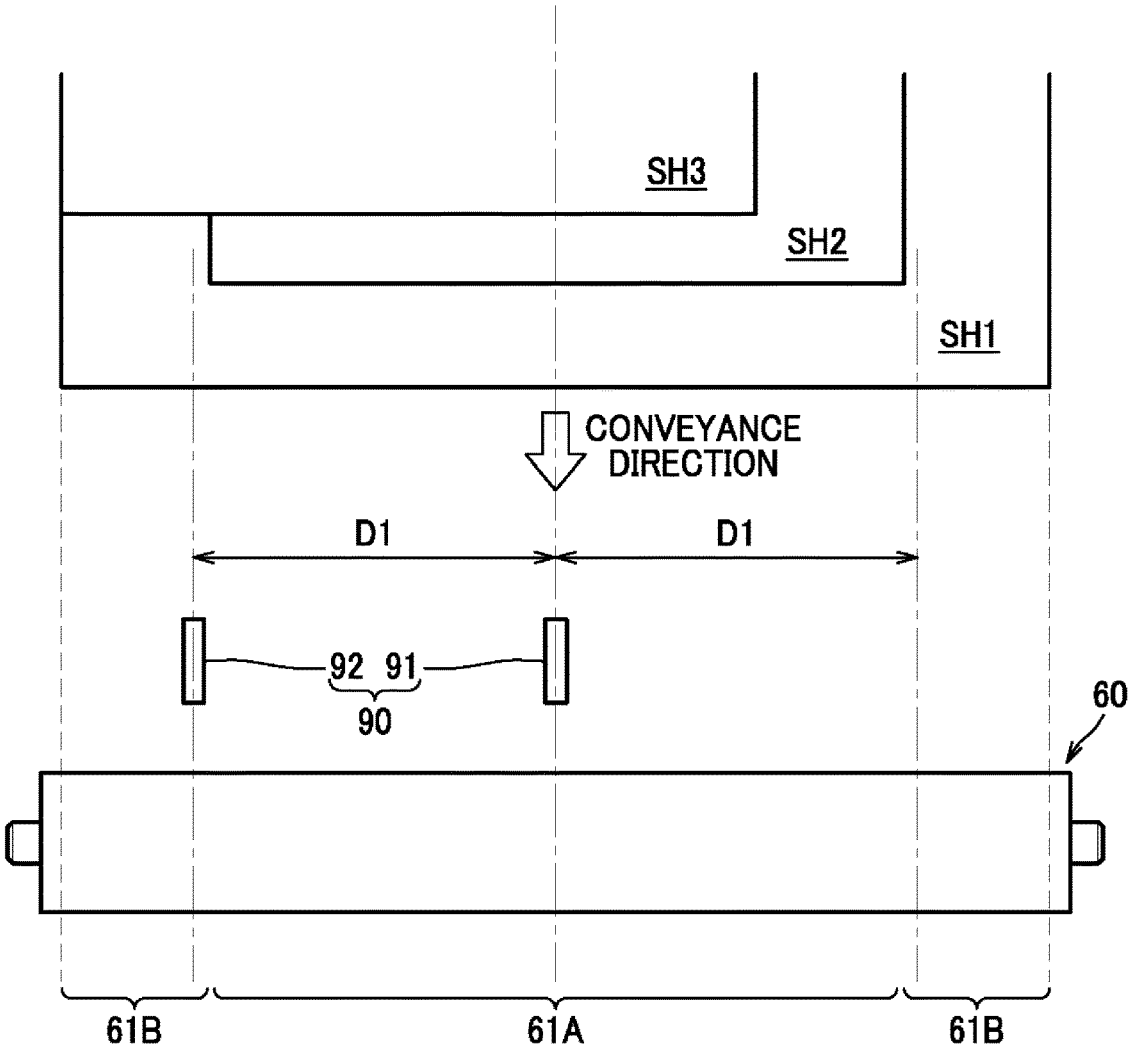
FIG. 4A is a diagram showing positions of sheet sensors in a sheet conveyance path.
FIG. 4B is a table showing results of detection of the sheet sensors for respective sheets.

As shown in FIG. 4A, the layer transfer device 1 further comprises a sheet sensor 90 for detecting passage of a sheet S. The sheet sensor 90 is located upstream of the heating unit in the direction of conveyance of the sheet S. The sheet sensor 90 includes a center sheet sensor 91 and a side sheet sensor 92. The center sheet sensor 91 and the side sheet sensor 92 are pivotably supported on the housing main body 21. The center sheet sensor 91 and the side sheet sensor 92 are pivoted and turned ON upon contacting the sheet S (see FIG. 1).

The center sheet sensor 91 is located in a position corresponding to the first portion 61A of the heating member 61 in the width direction. The center sheet sensor 91 is capable of detecting whether or not the sheet S passes over the surface of the first portion 61A. In the illustrated example, the center sheet sensor 91 is located in the center of the conveyance path of the sheet S in the width direction.

The side sheet sensor 92 is located in a position corresponding to the second portion 61B of the heating member 61 in the width direction. The side sheet sensor 92 is capable of detecting whether or not the sheet S passes over the surface of the second portion 61B. In the illustrated example, the side sheet sensor 92 is located apart from the center of the conveyance path of the sheet S at a distance D1, specifically at 75 to 85 mm, in the width direction.

As shown in FIGS. 4A, 4B, if the sheet S is a sheet SH1 which passes over the surfaces of the first portion 61A and the second portions 61B, the center sheet sensor 91 and the side sheet sensor 92 will both be turned ON. The sheet SH1 is, for example, an A4 size sheet (with a width of 210 mm) or a letter size sheet (with a width of 215.9 mm).

If the sheet S is a sheet SH2 which passes over the surface of the first portion 61A, but does not pass over the surface of the second portions 61B, only the center sheet sensor 91 will be turned ON. The sheet SH2 is, for example, a A5 size sheet (with a width of 148 mm) or an A6 size sheet (with a width of 105 mm) positioned in the center.

If the sheet is a sheet SH3 which passes over surfaces of the first portion 61A and one of the second portions 61B, the center sheet sensor 91 and the side sheet sensor 92 will both be turned ON. The sheet SH3 is, for example, an A5 size sheet (with a width of 148 mm) or an A6 size sheet (with a width of 105 mm) offset to one side.

Referring back to FIG. 1, the layer transfer device 1 further comprises a contact/separation mechanism 70 which causes at least one of the heating unit 60 and the pressure roller 51 to move between a contact position in which the pressure roller 51 applies pressure to the heating unit 60 and a separate position in which the heating unit 60 and the pressure roller 51 are separated.

In the illustrated example, the contact/separation mechanism 70 causes the heating unit 60 to move so that the heating unit 60 moves into contact with or moves apart from the multilayer film F. When the cover 22 is closed and the controller 80 executes a layer transfer control process, the contact/separation mechanism 70 causes the heating unit 60 to move to the contact position in which the heating unit 60 contacts the multilayer film F. When the cover 22 is opened or when no layer transfer process is executed on a sheet S in the transfer unit 50, the contact/separation mechanism 70 causes the heating unit 60 to be positioned in the separate position in which the heating unit 60 is separated from the multilayer film F.

The controller 80 comprises a CPU, a ROM, a RAM, a nonvolatile memory, etc., and is configured to execute various kinds of control based on programs provided in advance. The ROM, the RAM, the nonvolatile memory, etc. stores, for example, an optimal control table for an installed multilayer film as data necessary for the layer transfer control process. For example, when a user operates an operation panel 85 provided on the cover 22 of the housing 2 to transfer a layer on a sheet S, the controller 80 receives a signal from the operation panel 85 and transfers the layer.

With the layer transfer device 1 configured as described above, when a layer is transferred, sheets S stacked on the sheet tray 3 with front surfaces facing downward are conveyed one by one toward the transfer unit 50 by the sheet feed mechanism 11. Each sheet S is laid on a multilayer film F supplied from the supply reel 31 at a position upstream of the transfer unit 50 in the conveyance direction, and conveyed to the transfer unit 50 with the toner image on the sheet S in contact with the multilayer film F.

In the transfer unit 50, the sheet S and the multilayer film F nipped and passing through between the pressure roller 51 and the heating unit 60 are heated and pressurized by the heating unit 60 and the pressure roller 51, so that the layer is transferred onto the toner image.

After the layer is transferred, the sheet S and the multilayer film F adhered to each other are conveyed to the second guide shaft 42. When the sheet S and the multilayer film F travels past the second guide shaft 42, the direction of conveyance of the multilayer film F is changed to a direction different from the direction of conveyance of the sheet S. Thereby, the multilayer film F is peeled from the sheet S.

The multilayer film F peeled from the sheet S is taken up on the take-up reel 35. On the other hand, the sheet S from which the multilayer film F is peeled is ejected to the outside of the housing 2 by the sheet ejection mechanism 12 with a surface including the transferred layer facing downward.

Next, the film unit FU will be described with reference to FIG. 5 and FIG. 6.

Figure 5:
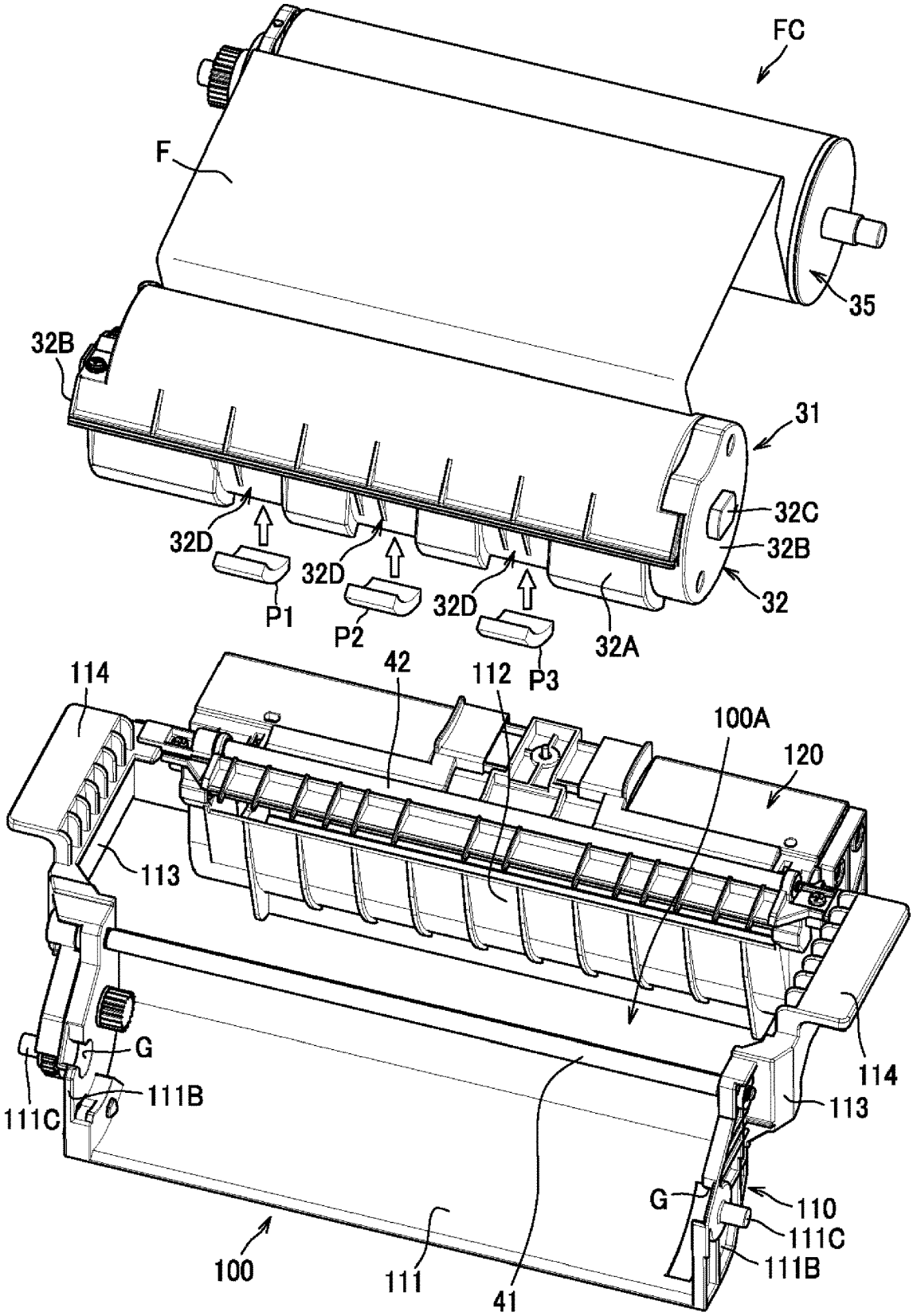
FIG. 5 is an exploded perspective view of a film unit with a film cartridge removed from a holder.

As shown in FIG. 5, the film unit FU includes a holder 100 made of plastic or the like, and a film cartridge FC installable into and removable from the holder 100. The film cartridge FC includes the multilayer film F, the supply reel 31 and the take-up reel 35 described above, and a supply case 32. The film cartridge FC installed in the holder 100 is installable into and removable from the housing main body 21.

The supply reel 31 (more specifically, the supply case 32) and the take-up reel 35 are installable into and removable from the holder 100 in directions orthogonal to the axial direction of the supply reel 31.

The supply case 32 is a hollow case accommodating the supply reel 31. The supply case 32 is made of plastic or the like, and includes an outer peripheral wall 32A having a substantially cylindrical surface, and two side walls 32B each having a shape of a substantially circular disc and provided at both ends of the outer peripheral wall 32A. The supply reel 31 is rotatably supported by the respective side walls 32B of the supply case 32.

The outer peripheral wall 32A includes three concave portions 32D formed side by side in the axial direction of the supply reel 31. Engagement pieces P1, P2, P3 which serve as identifiers can be fixed in each of the concave portions 32D.

Each of the side walls 32B includes an engagement portion 32C having an elongate shape as viewed in the axial direction of the supply reel 31. Each engagement portion 32C is a portion to be guided by an installation/removal guide G of the holder 100 which will be described later, and is formed in a shape of a rounded corner rectangle.

The holder 100 comprises a base frame 110 and a restraining frame 120 rotatably (movably) supported by the base frame 110. The the first guide shaft 41 and the second guide shaft 42 described above are rotatably supported by the base frame 110. The base frame 110 includes a first holding portion 111, a second holding portion 112, two connecting portions 113 and two handles 114. The third guide shaft 43 is rotatably supported by the restraining frame 120.

The first holding portion 111 is a portion that holds the supply case 32. The first holding portion 111 holds the supply reel 31 via the supply case 32. The first holding portion 111 includes two side walls 111B. Each side wall 111B has an installation/removal guide G for guiding the supply case 32 along a predetermined direction when the supply case 32 is installed and removed. The installation/removal guide G is formed in an inner surface facing inward in the axial direction (inner surface facing the supply case 32 in the axial direction) of each side wall 111B. Each installation/removal guide G has a narrow opening through which the engagement portion 32C is inserted.

Each side wall 111B includes a boss 111C on an outer surface thereof. Each boss 111C is a portion to be guided by the first locating portion GD1 (see FIG. 2) formed in the housing main body 21 when the film unit FU is installed into and removed from the housing main body 21.

The second holding portion 112 is a portion that holds the take-up reel 35. To be more specific, the second holding portion 112 forms a hollow case with the restraining frame 120, and the take-up reel 35 is accommodated in the hollow case.

The two connecting portions 113 are portions that connect the first holding portion 111 and the second holding portion 112. The connecting portions 113 are arranged apart from each other in the axial direction of the supply reel 31.

With the connecting portions 113 being formed in this way, the holder 100 is provided with a through hole 100A extending in an orthogonal direction orthogonal to the axial direction of the supply reel 31. Each handle 114 is provided on a corresponding connecting portion 113. The handles 114 are located on the holder 100 at opposite ends of the take-up reel 35.

When the film cartridge FC is removed from the holder 100, the supply case 32 is slightly rotated in the front-rear direction so that an angle of each engagement portion 32C is adjusted at an angle which allows the engagement portions 32C to be pulled out from the respective installation/removal guides G, and then the supply case 32 is lifted in the orthogonal direction and pulled out of the first holding portion 111. Further, the restraining frame 120 is opened, and then the take-up reel 35 is lifted in the orthogonal direction and pulled out of the second holding portion 112.

On the other hand, when the film cartridge FC is installed in the holder 100, the supply case 32 is installed in the first holding portion 111, and then the take-up reel 35 is installed in the second holding portion 112. When the supply case 32 is installed, the supply case 32 with each engagement portion 32C oriented at an angle which allows each engagement portion 32C to pass through the opening of the installation/removal guide G is inserted in the first holding portion 111, and then the supply case 32 is slightly rotated to position each engagement portion 32C in an inward room of the installation/removal guide G so that the supply reel 31 will not come off. The take-up reel 35 is installed by inserting the take-up reel 35 into the second holding portion 112, and then closing the restraining frame 120.

As described above, the film cartridge FC is configured such that the supply reel 31 is installable into and removable from the first locating portion GP1 via the supply case 32 and the boss 111C of the holder 100, and the take-up reel 35 is installable into and removable from the second locating portion GD2.

Film cartridges FC containing multilayer films of different widths located in different positions can be installed in the holder 100. For example, a first film cartridge FC1, a second film cartridge FC2, or a third film cartridge FC3 is installable in the holder 100.

Figure 6A:
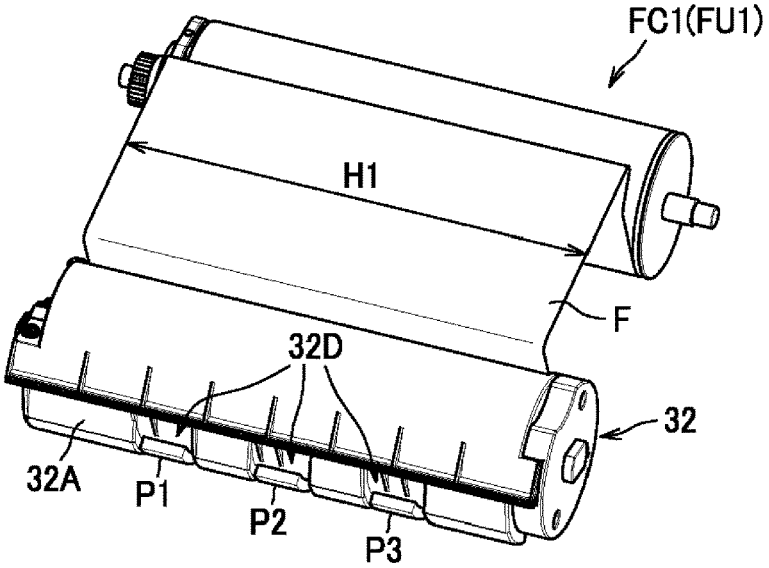
FIG. 6A is a perspective view of a first film unit.

A film unit FU in which a first film cartridge FC1 with a multilayer film F of a width H1 is installed, as shown in FIG. 6A, is referred to as a first film unit FU1. The first film unit HA installed in the layer transfer device 1 holds the multilayer film F in such a manner that the multilayer film F faces both of the first portion 61A and the second portions 61B. The width H1 is a maximum width of a multilayer film F that can be disposed in the film unit FU. The width H1 is, for example, 220 mm.

In the first film unit HA, the engagement pieces P1, P2, P3 are respectively fixed to all three concave portions 32D formed on the outer peripheral wall 32A.

Figure 6B:
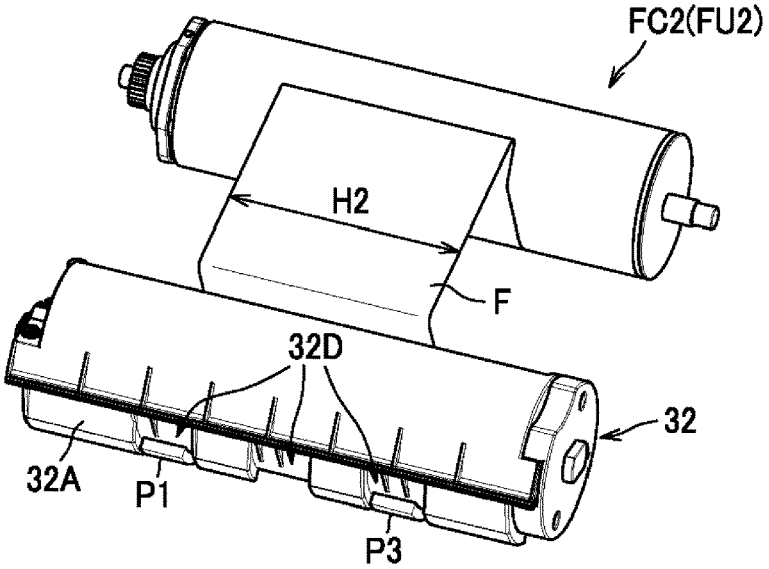
FIG. 6B is a perspective view of a second film unit.

A film unit FU in which a second film cartridge FC2 with a multilayer film F having a width H2 and positioned in the center is installed, as shown in FIG. 6B, is referred to as a second film unit FU2. The second film unit FU2 installed in the layer transfer device 1 holds the multilayer film F in such a manner that the multilayer film F does not face the second portions 61B and only faces the first portion 61A. The width H2 is smaller than the width H1. The width H2 is, for example, 110 mm.

In the second film unit FU2, the engagement pieces P1, P3 are fixed to the two concave portions 32D on the left and right sides among the three concave portions 32D formed on the outer peripheral wall 32A, but no engagement piece is fixed to the concave portion 32D in the middle.

Figure 6C:
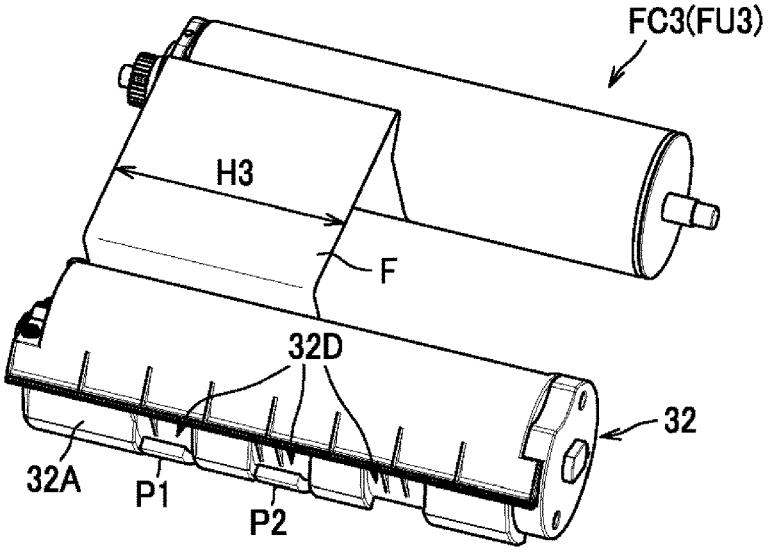
FIG. 6C is a perspective view of a third film unit.

A film unit FU in which a third film cartridge FC3 with a multilayer film F having a width H3 and offset to one side is installed, as shown in FIG. 6C, is referred to as a third film unit FU3. The third film unit FU3 installed in the layer transfer device 1 holds the multilayer film F in such a manner that the multilayer film F faces both of the first portion 61A and the second portion 61B. The width H3 is smaller than the width H1. The width H3 is, for example, 110 mm.

In the third film unit FU3, among the three concave portions 32D formed on the outer peripheral wall 32A, the concave portions 32D to which the engagement pieces P1, P2 are fixed are the middle concave portion 32D and one of the left and right concave portions 32D, whereas no engagement piece is fixed to the other of the left and right concave portions 32D.

Figures 7A, 7B:
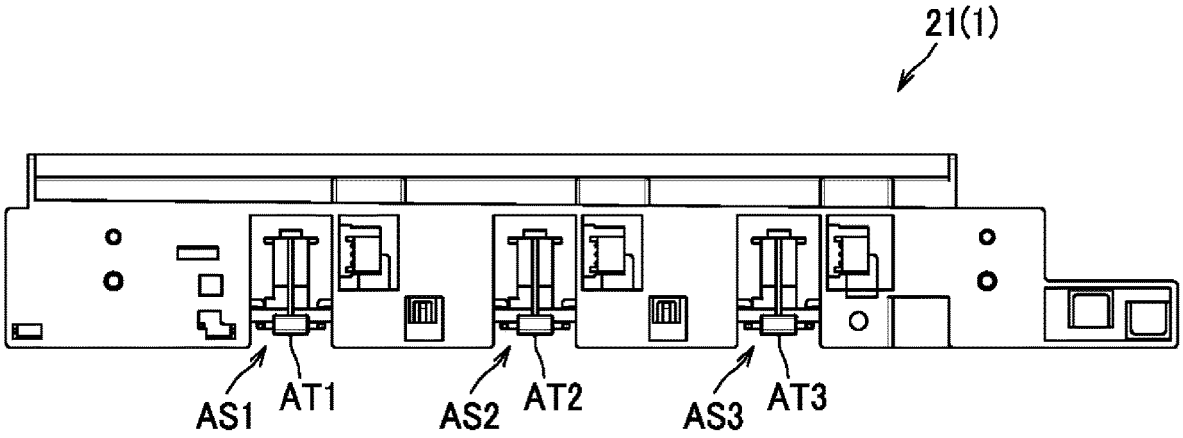
FIG. 7A is a diagram showing three film sensors.
FIG. 7B is a table showing results of detection of the respective film sensors.

As shown in FIG. 7A, the layer transfer device 1 comprises three installation detection sensors AS1, AS2, AS3 as an example of a film sensor capable of detecting whether or not the multilayer film passes over the surface of the second portion 61B of the heating member 61.

Figure 8A:
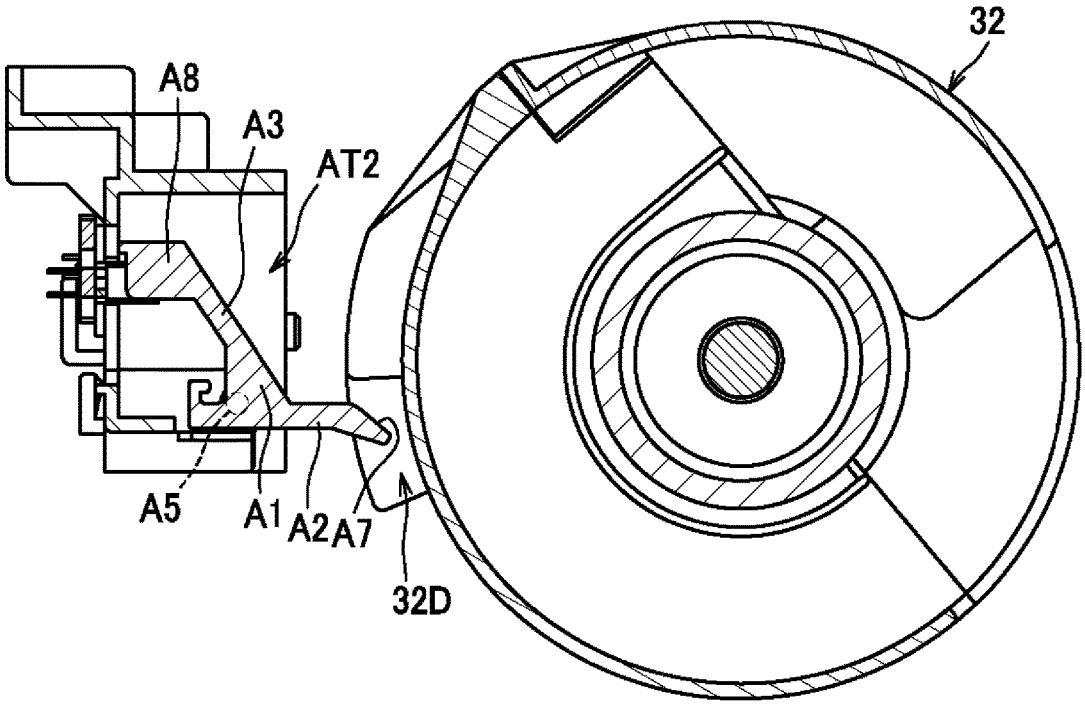
FIG. 8A is a diagram showing an actuator in a shield position.
Figure 8B:
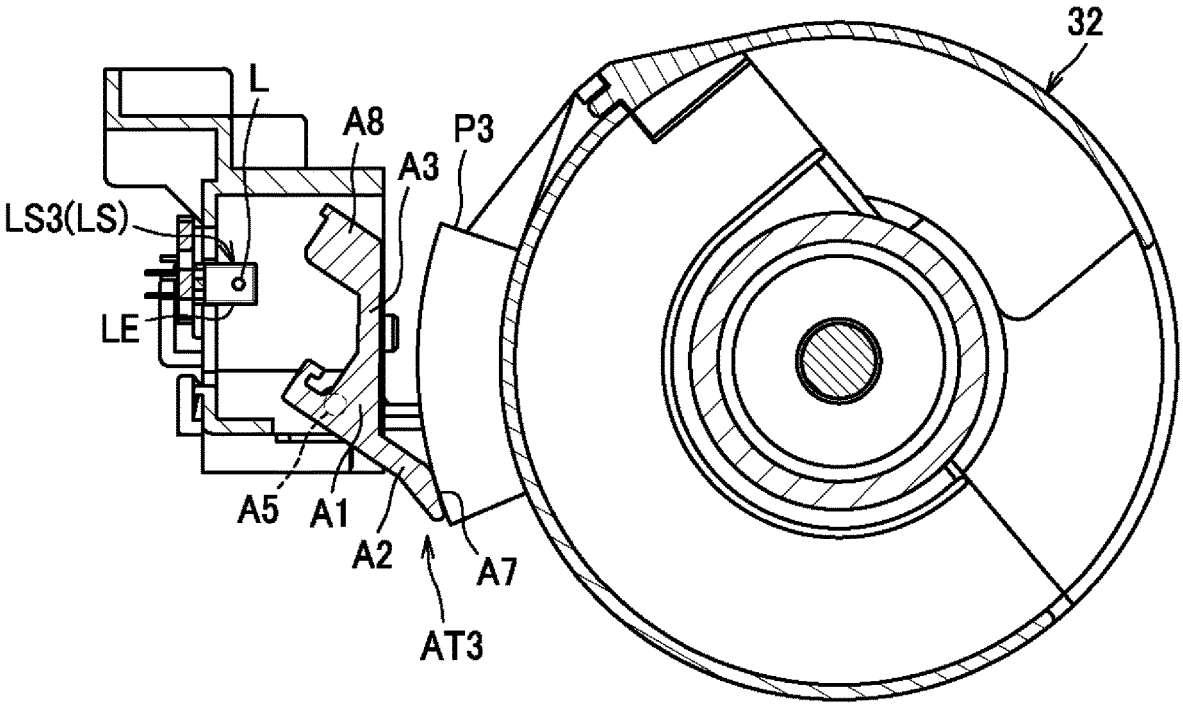
FIG. 8B is a diagram showing the actuator in an open position.

Each installation detection sensor AS1, AS2, AS3 comprises an actuator AT1, AT2, AT3, and a transmissive optical sensor LS corresponding to each actuator AT1, AT2, AT3 (only the optical sensor LS3 corresponding to the actuator AT3 is shown in FIG. 8B).

Each optical sensor LS comprises a light-emitting element LE and a light-receiving element (not shown). Each actuator AT1, AT2, AT3 is positioned between the light-emitting element LE and the light-receiving element. The optical sensor LS sends a signal indicating LOW to the controller 80, when the light-receiving element (not shown) receives light L from the light-emitting element LE. Further, the optical sensor LS sends a signal indicating HIGH to the controller 80, when the light-receiving element does not receive light L from the light-emitting element LE.

When the film unit FU is installed in the housing main body 21, each actuator AT1, AT2, AT3 is located for example, in a position corresponding to one of the three concave portions 32D formed on the outer peripheral wall 32A of the supply case 32.

Each actuator AT1, AT2, AT3 is pivotable between a shield position (see FIG. 8A) in which the light-receiving element (not shown) does not receive light L from the light-emitting element LE and an open position (see FIG. 8B) in which the light-receiving element (not shown) receives light L from the light-emitting element LE.

When the first film unit HA is installed in the housing main body 21, all of the actuators AT1, AT2, AT3 engage with the respective engagement pieces P1, P2, P3 and pivot from their shield positions to their open positions.

When the second film unit FU2 is installed in the housing main body 21, actuators AT1, AT3 engage with the respective engagement pieces P1, P3 and pivot from the shield position to the open position.

When the third film unit FU3 is installed in the housing main body 21, the actuators AT1, AT2 engage with the respective engagement pieces P1, P2 and pivot from the shield position to the open position.

To be more specific, as shown in FIG. 8A and FIG. 8B, the actuators AT1, AT2, AT3 are configured the same. The actuators AT1, AT2, AT3 each comprise a main body A1, a first leg A2, and a second leg A3. The main body A1 has a substantially triangular shape. The first leg A2 extends in one direction along one side of the main body A1. The second leg A3 extends in a direction different from the one direction along another side of the main body A1.

The main body A1 includes a rotation shaft A5 rotatably supported by the housing main body 21. The first leg A2 includes, at one end, an engagement surface A7 that is engagable with a corresponding engagement piece P1, P2, P3. The second leg A3 has a shield surface A8 that provides a shield between the light-emitting element LE and the light-receiving element (not shown).

Each of the actuators AT1, AT2, AT3 is biased to the shield position shown in FIG. 8A by a respective spring (not shown).

As shown in FIG. 8A, when the second film unit FU2 is installed in the housing main body 21, the actuator AT2 does not pivot from the shield position because no engagement piece is fixed to the middle concave portion 32D among the three concave portions 32D formed on the outer peripheral wall 32A of the supply case 32.

At this point in time, the shield surface A8 of the actuator AT2 is located between the light-emitting element LE and the light-receiving element (not shown), blocking light L from the light-emitting element LE. Thus, the light-receiving element cannot receive light L from the light-emitting element LE.

On the other hand, when the second film unit FU 2 is installed in the housing main body 21 as shown in FIG. 8B, because the engagement piece P3 is fixed to the right side concave portion 32D among the three concave portions 32D formed on the outer peripheral wall 32A of the supply case 32, the engagement piece P3 engages with the engagement surface A7 of the actuator AT3 and causes the actuator AT3 to pivot in the clockwise-direction as shown in FIG. 8B. As a result, the actuator AT3 pivots from the shield position to the open position, causing light L from the light-emitting element LE which was blocked by the shield surface A8 to be received by the light-receiving element.

The controller 80 receives signals from the three installation detection sensors AS1, AS2, AS3. Thus, based on the received signal, the controller 80 is capable of determining which one of the first film unit FU1, second film unit FU2, and third film unit FU3 is installed in the housing main body 21

To be more specific, as shown in the table of FIG. 7B, if the signals from the optical sensor corresponding to the actuator AT1 (first sensor), the optical sensor corresponding to the actuator AT2 (second sensor), and the optical sensor corresponding to the actuator AT3 (third sensor) are all LOW, the controller 80 determines that the first film unit FU1 is installed in the housing main body 21.

If the signals from the first sensor and the third sensor are LOW, and the signal from the second sensor is HIGH, the controller 80 determines that the second film unit FU2 is installed in the housing main body 21.

If the signals from the first sensor and the second sensor are LOW, and the signal from the third sensor is HIGH, the controller 80 determines that the third film unit FU3 is installed in the housing main body 21.

Further, if the signals from the first sensor, the second sensor, and the third sensor are all HIGH, the controller 80 determines that none of the first film unit FU1, the second film unit FU2, or the third film unit FU3 is installed in the housing main body 21.

The three installation detection sensors AS1, AS2, AS3 in combination serve as a film sensor that outputs a first signal to the controller 80 when the multilayer film F is held in the layer transfer device 1 in such a manner that the multilayer film F faces both of the first portion 61A and the second portion 61B. That is, the three installation detection sensors AS1, AS2, AS3 output the first signal to the controller 80 when the first film unit HA or the third film unit FU3 is installed.

The three installation detection sensors AS1, AS2, AS3 in combination serve to output a second signal to the controller 80 when the multilayer film F is held in the layer transfer device 1 in such a manner that the multilayer film F does not face the second portion 61B and only faces the first portion 61A. That is, the three installation detection sensors AS1, AS2, AS3 output the second signal to the controller 80 when the second film unit FU2 is installed.

When the first signal is received, the controller 80 determines that the multilayer film F passes over the surface of the second portion 61B of the heating member 61. When the second signal is received, the controller 80 determines that the multilayer film F does not pass over the surface of the second portion 61B of the heating member 61.

During transfer of the layer, the controller 80 is capable of controlling the first heater 62 with an input power set at a predetermined input power and is capable of controlling the second heater 63 with an input power set at a first input power or at a second input power that is smaller than the first input power. The second input power includes a zero input power, indicative that the second heater is in an OFF state. In the illustrated example, the second input power is zero, i.e., when the second heater is controlled with an input power set at the second input power, the second heater is switched OFF.

When the first signal is received from the three installation detection sensors AS1, AS2, AS3, the controller 80 starts controlling the second heater 63 with the input power set at the first input power, before starting conveyance of the sheet S.

After starting conveyance of the sheet S, if a signal indicating that the sheet S does not pass over the surface of the second portion 61B of the heating member 61 is received from the sheet sensor 90, more specifically, if the side sheet sensor 92 is not turned ON within a predetermined time period after the center sheet sensor 91 is turned ON (within a time period in which the sheet S passes a position corresponding to the side sheet sensor 92), the controller 80 switches control of the second heater 63 from control with the input power set at the first input power to control with the input power set at the second input power.

When the second signal is received from the three installation detection sensors AS1, AS2, AS3, the controller 80 starts controlling the second heater 63 with the input power set at the second input power, before starting conveyance of the sheet S.

If both of the multilayer film F and the sheet S pass over a surface of the second portion 61B of the heating member 61, more specifically, if the side sheet sensor 92 is turned ON within a predetermined time period after the center sheet sensor 91 is turned ON (within the time period in which the sheet S passes the position corresponding to the side sheet sensor 92), the controller 80 controls the second heater 63 with an input power set at the first input power.

If at least one of the multilayer film F and the sheet S does not pass over the surface of the second portion 61B of the heating member 61, the controller 80 controls the second heater 63 with the input power set at the second input power.

If it is determined that the multilayer film F passes over the surface of the second portion 61B and a downstream part of a sheet S in the conveyance direction does not pass over the surface of the second portion 61B, the controller 80 controls the second heater 63 with the input power set at the second input power. Thereafter, if it is determined that the upstream part of the sheet S in the conveyance direction, of which the downstream part determined not to pass over the surface of the second portion 61B, passes over the surface of the second portion 61B, the controller 80 switches control of the second heater 63 from control with the input power set at the second input power to control with the input power set at the first input power.

Figure 10A:
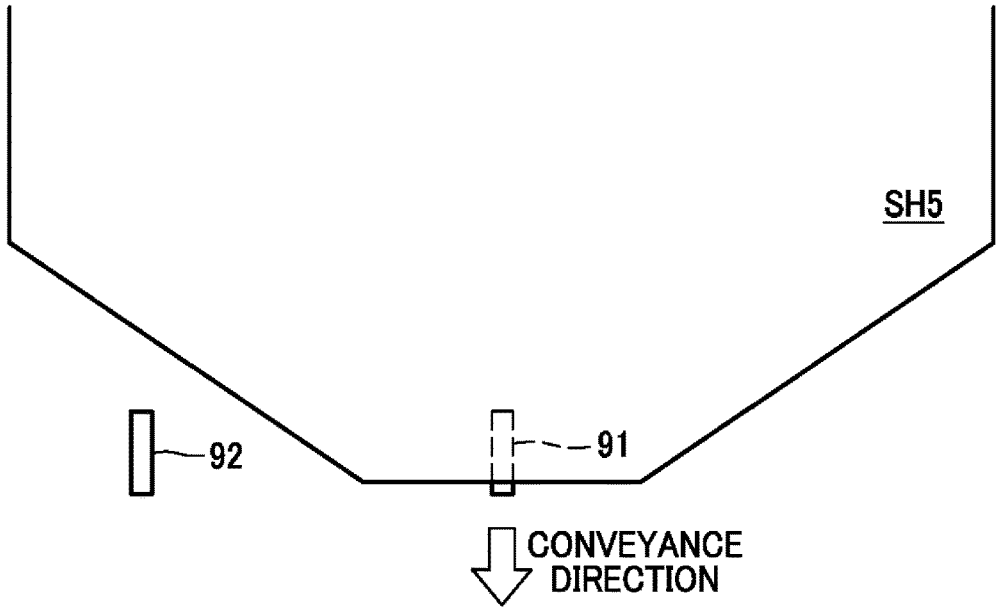
FIG. 10A is a diagram showing a trapezoidal sheet and positions of the sheet sensors.

The operation of the controller 80 when a sheet SH5, for example, as shown in FIG. 10A, having a leading end part (downstream side in the conveyance direction) with a narrow width and a trailing end part (upstream side in the conveyance direction) with a broad width is conveyed will be described.

Figure 10B:
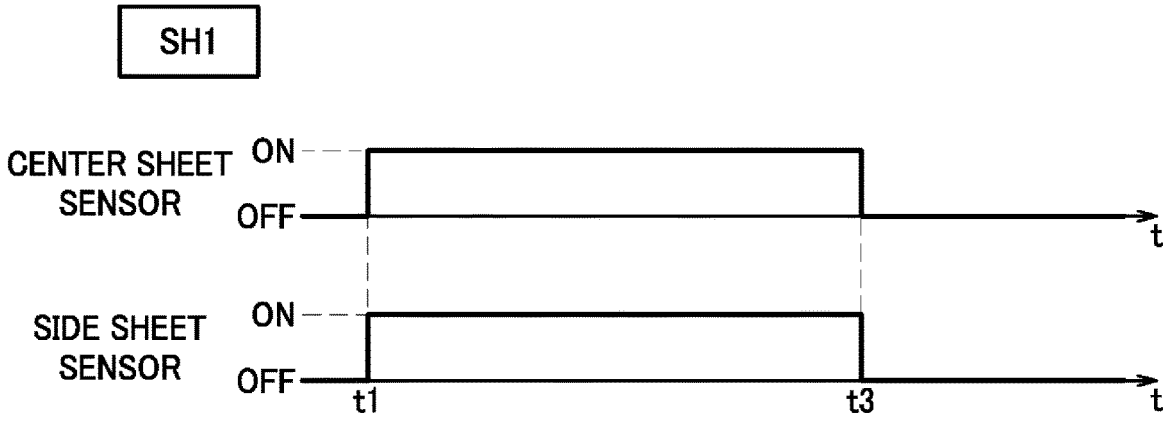
FIG. 10B is a time chart showing detection of a rectangular sheet by a center sheet sensor and a side sheet sensor.

As shown in FIG. 10B, when a rectangular sheet SH1 is conveyed, the center sheet sensor 91 and the side sheet sensor 92 are turned ON simultaneously (T=t1). Thereafter, the center sheet sensor 91 and the side sheet sensor 92 are turned OFF simultaneously (T=t3).

Figure 10C:
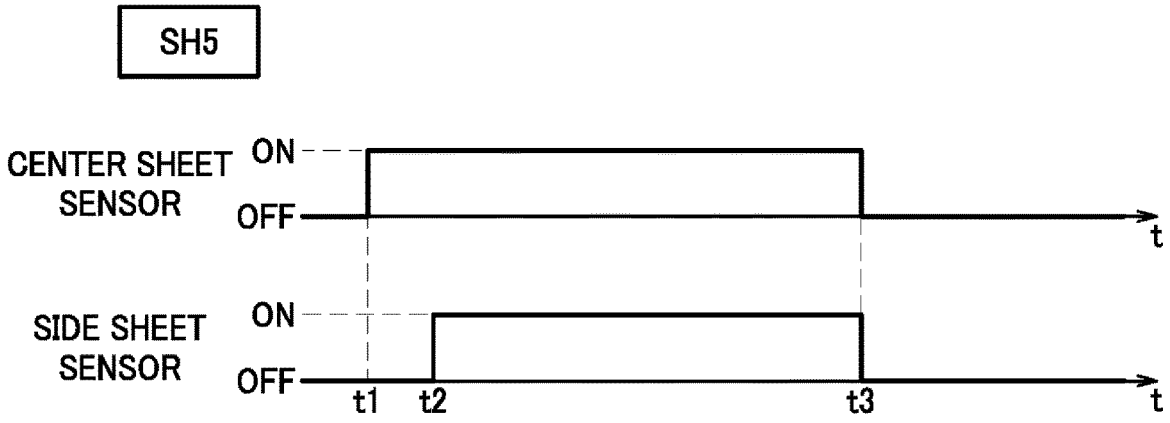
FIG. 10C is a time chart showing detection of a trapezoidal sheet by the center sheet sensor and the side sheet sensor.

On the other hand, as shown in FIG. 10C, when the sheet SH5 is conveyed, the side sheet sensor is turned ON (T=t2) after a delay from a time at which the center sheet sensor 91 is turned ON (T=t1). Thereafter, the center sheet sensor 91 and the side sheet sensor 92 are turned OFF simultaneously (T=t3).

If the side sheet sensor 92 is turned ON within the time period from a time when the center sheet sensor 91 is turned ON to a time when the center sheet sensor 91 is turned OFF (t1-t3), the controller can determine that the sheet S is similar to the sheet SH5, i.e., a sheet of which a downstream part in the conveyance direction does not pass over the surface of the second portion 61B and of which an upstream part in the conveyance direction passes over the second portion 61B.

The operation of the controller 80 when a sheet (for example, sheet SH1) with a broad width is conveyed after conveyance of a sheet (for example, sheet SH2) with a narrow width will be described.

If it is determined that a multilayer film F passes over the surface of the second portion 61B, and that a sheet S does not pass over the surface of the second portion 61B, the controller 80 sets the input power to the second heater 63 at the second input power.

If it is determined, after setting the input power to the second heater 63 at the second input power, that another sheet S, conveyed after the transfer of the layer onto the sheet S is finished, does not pass over the surface of the second portion 61B, the controller 80 starts conveyance of a next sheet S succeeding the another sheet S, before conveyance of the another sheet S ends.

If it is determined, after setting the input power to the second heater 63 at the second input power, that the another sheet S passes over the surface of the second portion 61B, the controller 80 prohibits the start of conveyance of the next sheet S, before conveyance of the another sheet S ends.

Next, an example operation of the controller 80 of the illustrated example will be described referring to the flowchart of FIG. 9.

Figure 9:
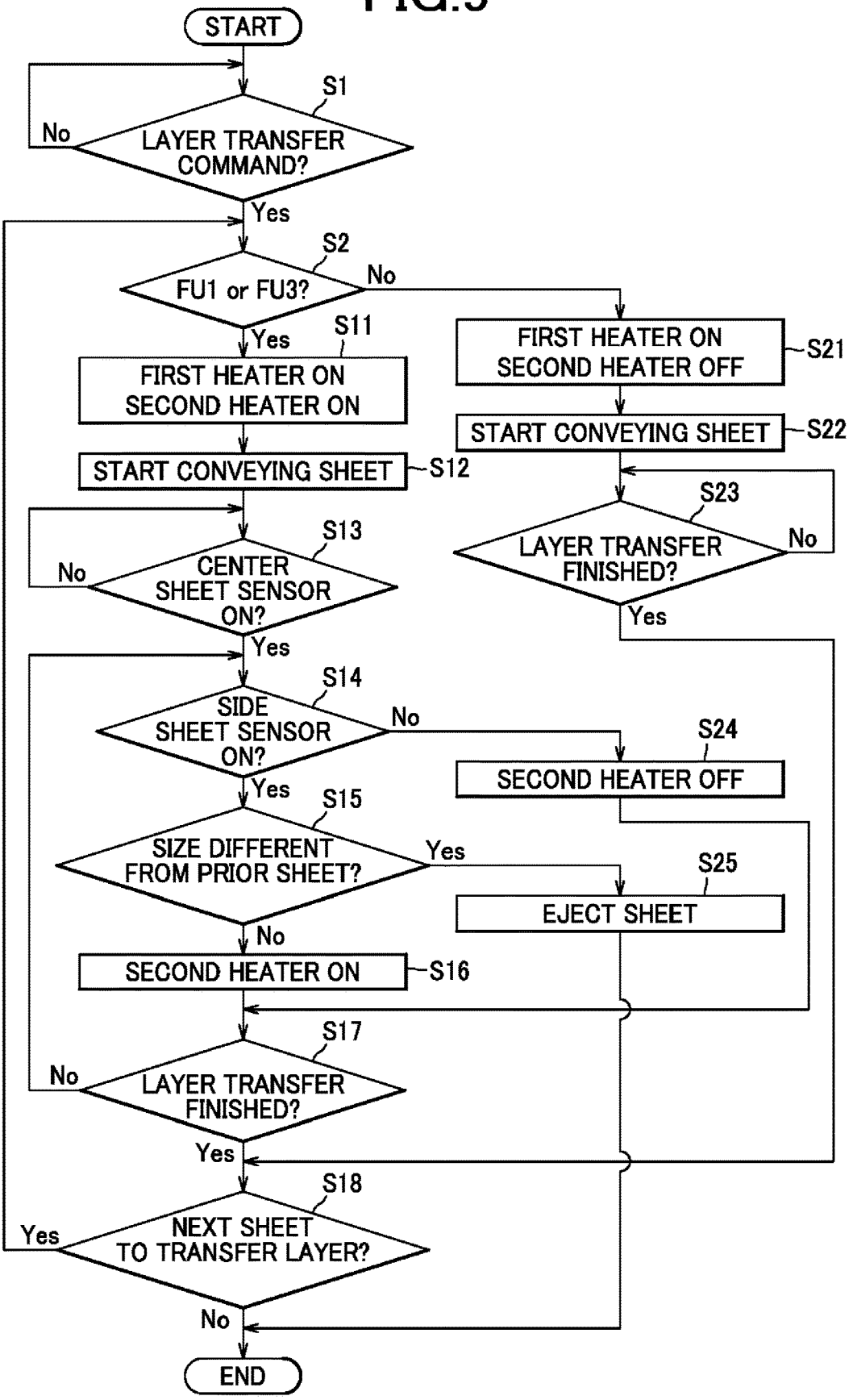
FIG. 9 is a flow chart of an operation of a controller.

As shown in FIG. 9, the controller 80 first determines whether or not there is a layer transfer command (S1). If it is determined that there is no layer transfer command (S1, No), the controller 80 waits until it receives a layer transfer command.

If it is determined, in step S1, that there is a layer transfer command (S1, Yes), the controller 80 determines if the film unit FU installed in the housing main body 21 is the first film unit FU1 or the third film unit FU3 (S2).

If it is determined, in step S2, that the installed film unit FU is not the first film unit HA or the third film unit FU3 (S2, No), the controller 80 switches the first heater 62 ON and the second heater 63 OFF (S21). After step S21, when the temperature of the heating member 61 reaches a predetermined temperature, conveyance of the sheet is started (S22). After step S22, the controller 80 determines if transfer of a layer has finished (S23).

If it is determined, in step S23, that the transfer of the layer is not finished (S23, No), the controller 80 waits until the transfer of the layer is finished. If it is determined that the transfer of the layer is finished (S23, Yes), the controller 80 proceeds to step S18.

On the other hand, if it is determined, in step S2, that the film unit FU is a first film unit HA or a third film unit FU3 (S2, Yes), the controller 80 switches or keeps the first heater 62 and the second heater 63 ON (S11). After step S11, when the temperature of the heating member 61 reaches a predetermined temperature, conveyance of the sheet S is started (S12). After step S12, the controller 80 determines if the center sheet sensor 91 is turned ON.

If it is determined, in step S13, that the center sheet sensor 91 is not turned ON, (S13, No), the controller 80 waits until the center sheet sensor 91 is turned ON. If it is determined that the center sheet sensor 91 is turned ON (S13, Yes), the controller 80 determines if the side sheet sensor 92 is turned ON within a predetermined time period (S14).

If it is determined, in step S14, that the side sheet sensor 92 has not been turned ON within a predetermined time period (S14, No), the controller 80 switches the second heater 63 OFF (S24) and proceeds to step S17. On the other hand, if it is determined, in step S14, that the side sheet sensor 92 has been turned ON within a predetermined time period (S14, Yes), the controller 80 determines if a size (width) of a sheet S presently being conveyed is different from that of a proceeding sheet S (S15).

If it is determined, in step S15, that the size (width) of the sheet S presently being conveyed is different from that of a proceeding sheet S (S15, Yes), the controller 80 ejects the sheet S presently being conveyed (S25) and ends the present process. Therefore, the controller 80 does not convey a next sheet even if there remains a layer transfer command.

On the other hand, if it is determined, in step S15, that the size (width) of the sheet S presently being conveyed is not different from that of a proceeding sheet S (S15, No), the controller 80 switches or keeps the second heater 63 ON (S16) and determines if transfer of a layer is finished (S17). It is to be understood that whether the transfer of the layer is finished may be determined based on, for example, the elapsed time after the center sheet sensor 91 is turned off.

If it is determined, in step S17, that the transfer of the layer is not finished (S17, No), the controller 80 proceeds to step S14. On the other hand, if it is determined, in step S17, that the transfer of the layer is finished (S17, Yes), the controller 80 determines if there is a succeeding sheet on which a layer is to be transferred (S18).

If it is determined, in step S18, that there is a succeeding sheet on which a layer is to be transferred (S18, Yes), the controller 80 proceeds to step S2. If it is determined that there is no succeeding sheet on which a layer is to be transferred (S18, No), the controller 80 ends the present process.

Next, an operation of the controller 80 when the sheet SH5 (see FIG. 10A) is conveyed with the first film unit HA or the third film unit FU3 installed will be described.

Since the first film unit HA or the third film unit FU3 is installed, it is determined, in step S2, that the multilayer film F passes over the surface of the second portion 61B (S2, Yes), and the controller 80 switches the first heater 62 and the second heater 63 ON (S11), starts conveyance of the sheet S (S12), and proceeds to step S13.

After the center sheet sensor 91 is turned on (S13), the side sheet sensor 92 is not turned on by the sheet SH5 (specifically, the downstream part of the sheet SH5 in the conveyance direction) (S14, No), thus the controller 80 switches the second heater 63 OFF (S24).

After step S24, since the transfer of the layer is not finished (S17, No), the controller 80 proceeds to step S14 again. In step S14, when the sheet SH5 (specifically, the upstream pat of the sheet SH5 in the conveyance direction) turns the side sheet sensor 92 ON before the transfer of the layer finishes, the controller 80 determines that the sheet SH5 passes over the surface of the second portion 61B (S14, Yes) and proceeds to step S15.

In step S15, the controller 80 determines that a size of the sheet S is not different from that of a preceding sheet S (S15, No), and switches the second heater 63 ON (S16).

Next, an operation of the controller 80 with the first film unit FU1 or the third film unit FU3 installed, when another sheet S conveyed, after transfer of a layer is finished on a centered sheet with a narrow width (for example, sheet SH2), is a broad-width sheet S will be described.

Since the first film unit FU1 or the third film unit FU3 is installed, it is determined, in step S2, that the multilayer film F passes over the surface of the second portion 61B (S2, Yes), and the controller 80 switches the first heater 62 and the second heater 63 ON (S11), starts conveyance of the sheet S (S12), and proceeds to step S13.

After the center sheet sensor 91 is turned ON (S13), the sheet SH5 does not turn the side sheet sensor 92 ON (S14, No). Thus, the controller 80 determines that the sheet SH5 does not pass over the surface of second portion 61B and switches the second heater 63 OFF (S24).

After step S24, when the transfer of the layer is finished (S17, Yes), since there is a succeeding sheet SH1 on which a layer is to be transferred (S18, Yes), the controller 80 executes steps S11 to S14 after returning to step S2.

Since the side sheet sensor 92 is ON in step 14, the controller 80 determines that the another sheet SH1 which is being conveyed next passes over the surface of the second portion 61B (S14, Yes), and proceeds to step S15. In step S15, the controller 80 determines that the size of the another sheet SH1 is different from that of a preceding sheet (S15, Yes), ejects the another sheet SH1 (S25), and ends the process. Therefore, the next sheet S succeeding the another sheet SH1 is not conveyed.

According to the present embodiment described above, the following advantageous effects can be achieved.

The controller 80 controls the second heater 63 with the input power set at the second input power if at least one of the multilayer film F and the sheet S does not pass over the surface of the second portion 61B of the heating member 61. Accordingly, it is possible to restrain wasteful heating of the heating member 61 by the heater 63. Therefore, power consumption of the layer transfer device 1 can be saved.

The layer transfer device 1 comprises a film sensor capable of detecting whether or not the multilayer film F passes over the surface of the second portion 61B of the heating member 61. Therefore, the user does not have to take the trouble to input the size of the multilayer film F.

The layer transfer device 1 comprises a sheet sensor 90 capable of detecting whether or not the sheet S passes over the surface of the second portion 61B. Therefore, the user does not have to take the trouble to input the size of the sheet S.

Since the controller 80 starts to control the second heater 63 with the input power set at the first input power before starting conveyance of a sheet, the time it takes from the start of conveyance to the transfer of the layer is reduced.

Since the controller 80 switches control of the second heater 63 to control with the input power set at the second input power if the sheet S does not pass over the second portion 61B of the heating member 61, the second heater 63 can be restrained from wastefully heating the heating member 61. In this way, the time it takes until the transfer of the layer and power consumption can be reduced.

If the controller 80 receives a second signal, that is, if the multilayer film F does not pass over the surface of the second portion 61B of the heating member 61, the second heater 63 is controlled with the input power set at the second input power. Therefore, the wasteful heating of the heating member 61 can be restrained.

If it is determined that the multilayer film F passes over the surface of the second portion 61B and that the downstream part of the sheet S in the conveyance direction does not pass over the surface of the second portion 61B, the controller 80 sets the input power to the second heater at a second input power. Thereafter, if it is determined that the upstream part of the sheet S in the conveyance direction, of which the downstream part determined not to pass over the surface of the second portion 61B, passes over the surface of the second portion 61B, the controller 80 switches the control of the second heater 63 from control with the input power set at the second input power to control with the input power set at the first input power. Therefore, even when a sheet S, for example, with a downstream part in the conveyance direction having a narrow width and an upstream part in the conveyance direction having a broad width and not rectangular is conveyed, the heating of the part of the sheet S with the broad width can be restrained from becoming weak because the controller 80 switches the control from control with the input power set at the second input power to control with the input power set at the first input power.

If it is determined that the multilayer film F passes over the surface of the second portion 61B, and that the sheet S does not pass over the surface of the second portion 61B, the controller 80 sets the input power to the second heater 63 at the second input power. After the input power to the second heater 63 is set at the second input power, if it is determined that another sheet S, transferred after the transfer of the layer onto the sheet S is finished, does not pass over the surface of the second portion 61B, the controller 80 starts conveyance of the next sheet S, before conveyance of the another sheet is finished. After the input power to the second heater 63 is set at the second input power, if it is determined that the another sheet S passes over the surface of the second portion 61B, the controller 80 prohibits the start of conveyance of the next sheet S before conveyance of the another sheet S ends. Therefore, when another sheet with a broad width is conveyed after a layer is transferred onto a sheet S with a narrow width, the next sheet S is not conveyed. Thus, defective transfer of a layer on the next sheet can be restrained.

The above-described embodiment can be modified for practical application.

In the illustrated example, the heating member 61 is a roller comprised of a cylindrical metal tube. However, the heating member may be a film or a belt. Further, the heater for heating the heating member may be located either inside or outside of the heating member.

In the illustrated example, the second heater 63 is configured such that the thermal output of both end sections 63B are higher than the thermal output of the midsection 63A to heat the second portion 61B which includes both ends of the heating element 61 more intensively than the first portion 61A. However, the second heater may be configured such that the thermal output of only one of the two end sections 63B has a thermal output higher than the midsection 63A to heat only one of the second portions 61B of the heating member 61 more intensively than the first portion 61A. In this case, a third heater may be provided which is configured such that a thermal output of only one of two end sections in the width direction is higher than a midsection to heat only the other of the second portions 61B of the heating member 61 more intensively than the first portion 61A.

In the case that the second heater 63 is a heater configured such that the thermal output of only one of the two end sections 63B is higher than the thermal output of the midsection 63A to heat only one of the second portions 61B of the heating member 61 more intensively than the first portion 61A, the first heater 62 may be configured such that the thermal outputs of the midsection 62A and one of the two end sections 62B are higher than the thermal output of the other of the two end sections 62B to heat the first portion 61A and the other of the second portions 61B more intensively than the one of the second portions 61B.

In the illustrated example, the sheet sensor includes one center sheet sensor and one side sheet sensor. However, the sheet sensor may include a plurality of center sheet sensors and side sheet sensors. In this case, it is desirable that the plurality of side sheet sensors be provided on both sides of the center sheet sensor in the width direction.

In the illustrated example, the film unit FU with the film cartridge FC installed in the holder 100 is installed in the layer transfer device. However, the film cartridge FC may be directly installed in the layer transfer device without installing the film cartridge FC in a holder. In this case, the part corresponding to the holder 100 of the illustrated example may be formed as a part integral with the housing of the layer transfer device.

In the illustrated example, the film sensor outputs the first signal to the controller 80 if a first film unit FU1 is installed. However, a user may input via an operating unit information indicating that the first film unit FU1 is installed. Similarly, although the film sensor outputs the second signal to the controller 80 if the second film unit FU2 is installed, in the illustrated example, the user may input via an operating unit information indicating that the second film unit FU1 is installed.

Although a fixing speed (processing speed) is not changed according to a type of layer to be transferred in the illustrated example, the fixing speed (processing speed) may be changed according to the type of layer to be transferred. Further, the fixing speed (processing speed) may be changed according to material or thickness of the layer.

For example, if it is determined that the transfer layer contains foil, the controller 80 may set the process speed at V1, and if it is determined that the transfer layer does not contain foil, the controller 80 may set the process speed at V2 which is slower than V1.

In the illustrated example, the layer transfer device 1 is configured such that the heating unit 60 is movable by the contact/separation mechanism 70. However, a pressure member or both of the heating unit and the pressure member may be moved by the contact/separation mechanism.

The elements described in the above embodiment may be implemented selectively and in combination.

What is claimed is:

1. A layer transfer device for transferring a foil layer of a multilayer film onto an image formed on a sheet, the layer transfer device comprising:

a heating member configured to contact and heat the multilayer film and extending along a width direction of the multilayer film, the width direction being orthogonal to a direction of conveyance of the multilayer film;

a first heater configured to heat a first portion of the heating member more intensively than a second portion of the heating member, the first portion and the second portion being arranged side by side along the width direction;

a second heater configured to heat the second portion more intensively than the first portion; and a controller, wherein, during transfer of the foil layer, the controller is configured to:

control the first heater with an input power set at a predetermined input power, control the second heater with an input power set at a first input power if both of the multilayer film and the sheet pass over a surface of the second portion, and control the second heater with an input power set at a second input power that is smaller than the first input power if at least one of the multilayer film and the sheet does not pass over the surface of the second portion.

2. The layer transfer device according to claim 1, wherein the controller is configured to:

make a determination, upon receipt of a first signal, that the multilayer film passes over the surface of the second portion, and make a determination, upon receipt of a second signal, that the multilayer film does not pass over the surface of the second portion.

3. The layer transfer device according to claim 2, further comprising a film sensor capable of detecting whether or not the multilayer film passes over the surface of the second portion, wherein the film sensor is configured to:

output the first signal to the controller when the multilayer film is held in the layer transfer device in such a manner that the multilayer film faces both of the first portion and the second portion, and output the second signal to the controller when the multilayer film is held in the layer transfer device in such a manner that the multilayer film does not face the second portion and faces the first portion.

4. The layer transfer device according to claim 3, wherein the layer transfer device is configured such that a first film cartridge or a second film cartridge is installable therein, wherein the first film cartridge installed in the layer transfer device holds the multilayer film in such a manner that the multilayer film faces both of the first portion and the second portion, wherein the second film cartridge installed in the layer transfer device holds the multilayer film in such a manner that the multilayer film does not face the second portion and faces the first portion, and wherein the film sensor is configured to:

output the first signal to the controller when the first film cartridge is installed, and output the second signal to the controller when the second film cartridge is installed.

5. The layer transfer device according to claim 3, comprising a sheet sensor located upstream of the heating member in a direction of conveyance of the sheet and configured to be capable of detecting whether or not the sheet passes over the surface of the second portion.

6. The layer transfer device according to claim 5, wherein the controller is configured to:

start control over the second heater, upon receipt of the first signal from the film sensor, with the input power set at the first input power before starting conveyance of the sheet, and switch the control over the second heater from control with the input power set at the first input power to control with the input power set at the second input power, if a signal indicating that the sheet does not pass over the surface of the second portion is received from the sheet sensor after starting the conveyance of the sheet.

7. The layer transfer device according to claim 5, wherein the controller is configured to start control over the second heater, upon receipt of the second signal from the film sensor, with the input power set at the second input power before starting conveyance of the sheet.

8. The layer transfer device according to claim 5, wherein the controller is configured such that:

after the second heater is controlled with the input power set at the second input power based on a determination that the multilayer film passes over the surface of the second portion, and a determination that a downstream part of the sheet in the direction of conveyance of the sheet does not pass over the surface of the second portion, if a determination is made that an upstream part of the sheet, of which the downstream part determined not to pass over the surface of the second portion in the direction of conveyance of the sheet, passes over the surface of the second portion, then the control over the second heater is switched from control with the input power set at the second input power to control with the input power set at the first input power.

9. The layer transfer device according to claim 5, wherein the controller is configured such that:

if a determination is made that the multilayer film passes over the surface of the second portion, and that the sheet does not pass over the surface of the second portion, the input power to the second heater is set at the second input power, if a determination is made after setting the input power to the second heater at the second input power that another sheet, conveyed after the transfer of the foil layer on the sheet is finished, does not pass over the surface of the second portion, conveyance of a next sheet succeeding the another sheet is started before conveyance of the another sheet ends, and if a determination is made after setting the input power to the second heater at the second input power that the another sheet passes over the surface of the second portion, the conveyance of the next sheet succeeding the another sheet is prohibited from starting before the conveyance of the another sheet ends.

10. The layer transfer device according to claim 1, wherein the first portion is a portion of the heating member located in a midsection thereof in the width direction, and the second portion are the portions of the heating member adjacent to both ends thereof in the width direction.

11. The layer transfer device according to claim 1, wherein the heating member is a roller.

12. A layer transfer device for transferring a layer of a multilayer film onto an image formed on a sheet, the layer transfer device comprising:

a heating member configured to contact and heat the multilayer film and extending along a width direction of the multilayer film, the width direction being orthogonal to a direction of conveyance of the multilayer film;

a first heater configured to heat a first portion of the heating member more intensively than a second portion of the heating member, the first portion and the second portion being arranged side by side along the width direction;

a second heater configured to heat the second portion more intensively than the first portion; and a controller, wherein, during transfer of the layer, the controller is configured to:

make a determination, upon receipt of a first signal, that the multilayer film passes over a surface of the second portion, make a determination, upon receipt of a second signal, that the multilayer film does not pass over the surface of the second portion, control the first heater with an input power set at a predetermined input power, control the second heater with an input power set at a first input power if both of the multilayer film and the sheet pass over the surface of the second portion, and control the second heater with an input power set at a second input power that is smaller than the first input power if at least one of the multilayer film and the sheet does not pass over the surface of the second portion.

13. The layer transfer device according to claim 12, wherein, if the controller makes a determination based on the second signal that the multilayer film does not pass over the surface of the second portion, the controller controls the second heater with an input power set at the second input power.

14. The layer transfer device according to claim 12, further comprising a film sensor capable of detecting whether or not the multilayer film passes over the surface of the second portion, wherein the film sensor is configured to:

output the first signal to the controller when the multilayer film is held in the layer transfer device in such a manner that the multilayer film faces both of the first portion and the second portion, and output the second signal to the controller when the multilayer film is held in the layer transfer device in such a manner that the multilayer film does not face the second portion and faces the first portion.

15. The layer transfer device according to claim 14, wherein the layer transfer device is configured such that a first film cartridge or a second film cartridge is installable therein, wherein the first film cartridge installed in the layer transfer device holds the multilayer film in such a manner that the multilayer film faces both of the first portion and the second portion, wherein the second film cartridge installed in the layer transfer device holds the multilayer film in such a manner that the multilayer film does not face the second portion and faces the first portion, and wherein the film sensor is configured to:

output the first signal to the controller when the first film cartridge is installed, and output the second signal to the controller when the second film cartridge is installed.

16. The layer transfer device according to claim 14, comprising a sheet sensor located upstream of the heating member in a direction of conveyance of the sheet and configured to be capable of detecting whether or not the sheet passes over the surface of the second portion.

17. The layer transfer device according to claim 16, wherein the controller is configured to:

start control over the second heater, upon receipt of the first signal from the film sensor, with the input power set at the first input power before starting conveyance of the sheet, and switch the control over the second heater from control with the input power set at the first input power to control with the input power set at the second input power, if a signal indicating that the sheet does not pass over the surface of the second portion is received from the sheet sensor after starting the conveyance of the sheet.

18. The layer transfer device according to claim 16, wherein the controller is configured to start control over the second heater, upon receipt of the second signal from the film sensor, with the input power set at the second input power before starting conveyance of the sheet.

19. The layer transfer device according to claim 16, wherein the controller is configured such that:

after the second heater is controlled with the input power set at the second input power based on a determination that the multilayer film passes over the surface of the second portion, and a determination that a downstream part of the sheet in the direction of conveyance of the sheet does not pass over the surface of the second portion, if a determination is made that an upstream part of the sheet, of which the downstream part determined not to pass over the surface of the second portion in the direction of conveyance of the sheet, passes over the surface of the second portion, then the control over the second heater is switched from control with the input power set at the second input power to control with the input power set at the first input power.

20. The layer transfer device according to claim 16, wherein the controller is configured such that:

if a determination is made that the multilayer film passes over the surface of the second portion, and that the sheet does not pass over the surface of the second portion, the input power to the second heater is set at the second input power, if a determination is made after setting the input power to the second heater at the second input power that another sheet, conveyed after the transfer of the layer on the sheet is finished, does not pass over the surface of the second portion, conveyance of a next sheet succeeding the another sheet is started before conveyance of the another sheet ends, and if a determination is made after setting the input power to the second heater at the second input power that the another sheet passes over the surface of the second portion, the conveyance of the next sheet succeeding the another sheet is prohibited from starting before the conveyance of the another sheet ends.

* * * * *